US010854964B2

(12) United States Patent
Kim et al.

(10) Patent No.: US 10,854,964 B2
(45) Date of Patent: Dec. 1, 2020

(54) ANTENNA APPARATUS AND VEHICLE INCLUDING THE SAME

(71) Applicants: Hyundai Motor Company, Seoul (KR); Kia Motors Corporation, Seoul (KR)

(72) Inventors: Byungguk Kim, Hwaseong-si (KR); Jisoo Baek, Anyang-si (KR); Hak Seong Kim, Seoul (KR); Sun Keun Lee, Gumi-si (KR); Yu Suhk Suh, Gunpo-si (KR); Yoon-Gi Kim, Gunpo-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 1 day.

(21) Appl. No.: 16/392,091

(22) Filed: Apr. 23, 2019

(65) Prior Publication Data

US 2020/0194882 A1 Jun. 18, 2020

(30) Foreign Application Priority Data

Dec. 13, 2018 (KR) ..... 10-2018-0161203

(51) Int. Cl.
*H01Q 1/52* (2006.01)
*H01Q 25/00* (2006.01)
*H01Q 9/42* (2006.01)
*H01Q 1/32* (2006.01)

(52) U.S. Cl.
CPC ..... *H01Q 1/521* (2013.01); *H01Q 1/3275* (2013.01); *H01Q 9/42* (2013.01); *H01Q 25/00* (2013.01)

(58) Field of Classification Search
CPC ..... H01Q 1/521; H01Q 25/00; H01Q 9/42; H01Q 1/3275
See application file for complete search history.

(56) References Cited

U.S. PATENT DOCUMENTS

2018/0069294 A1* 3/2018 Kang ..... H01Q 7/00
2018/0108972 A1* 4/2018 Park ..... G08G 1/161
2018/0241118 A1* 8/2018 Jeong ..... H01Q 1/3275

FOREIGN PATENT DOCUMENTS

KR 101347936 B1 1/2014
KR 20160108999 A 9/2016

* cited by examiner

*Primary Examiner* — Daniel D Chang
(74) *Attorney, Agent, or Firm* — Slater Matsil, LLP

(57) ABSTRACT

An antenna apparatus includes a circuit board disposed on a base, a first antenna part disposed on the circuit board, an inner cover configured to cover the first antenna part, and a second antenna part disposed on a surface of the inner cover. A vehicle can utilize the antenna for communication.

20 Claims, 6 Drawing Sheets

ANTENNA APPARATUS AND VEHICLE INCLUDING THE SAME

CROSS-REFERENCE TO RELATED APPLICATIONS

This application claims priority to Korean Patent Application No. 10-2018-0161203, filed in the Korean Intellectual Property Office on Dec. 13, 2018, which application is hereby incorporated herein by reference.

TECHNICAL FIELD

The present disclosure relates to an antenna apparatus and a vehicle including the same.

BACKGROUND

Currently, a unified antenna for a vehicle that may be used while being mounted on a vehicle is classified into a shark fin type antenna and a micro pole type antenna.

In addition, the unified antenna for a vehicle has detailed specifications that are divided according to the regions, specifications, telecommunication companies, regulations, and the like. A location information reception part is divided into a global positioning system (GPS), Global Orbiting Navigational Satellite System (Glonass), Galileo, Baidu, and the like, and in the case of terrestrial broadcasting, digital multimedia broadcasting (DMB) and digital audio broadcasting (DAB) are included. In North America, satellite radio SXM specification is added, and in Russia and Europe, an emergency call (eCall) antenna is further included. Further, in the case of mobile communication, such as 3G and LTE, frequency bands, available frequency bands vary depending on the country and the telecommunication company. In addition, the shark fin type antenna and the micro-pole type antenna, which need to be mounted on a vehicle, requires additional specifications for receiving terrestrial radio (AM/FM) signals.

Meanwhile, as the vehicle features are diversified and advanced, more and more antennas are included in the unified antenna for vehicle. Such an increase in the number of antennas may lower the degree of isolation.

SUMMARY

Embodiments of the present disclosure provide an antenna apparatus capable of accommodating a plurality of antennas and a vehicle including the same.

Additional aspects of the invention will be set forth in part in the description which follows and, in part, will be obvious from the description, or may be learned by practice of the invention.

Therefore, it is an aspect of the present invention to provide an antenna apparatus including a circuit board disposed on a base, a first antenna part disposed on the circuit board, an inner cover configured to cover the first antenna part, and a second antenna part disposed on a surface of the inner cover.

The second antenna part may include an amplitude modulation (AM)/frequency modulation (FM) antenna configured to receive signals of an AM/FM band and a digital multimedia broadcasting (DMB) antenna configured to receive signals of a DMB band.

The second antenna part may be implemented using flexible printed circuit board (FPCB).

The second antenna part may be disposed on at least one of an outer surface or an inner surface of the inner cover.

The AM/FM antenna may form a first conductive pattern, and the DMB antenna may form a second conductive pattern, and the first conductive pattern and the second conductive pattern may be different from each other.

The second antenna part may receive the signal through a feeding part connected to the circuit board.

The feeding part may be connected to the circuit board by a screw coupling to a clip extending from an upper side of the circuit board.

The first antenna part may include at least one of a 3G/4G antenna configured to receive signals of a 3G/4G band, a Vehicle to Everything (V2X) antenna configured to perform V2X communication or a satellite antenna configured to receive signals of a satellite frequency band.

The first antenna part may be implemented using a printed circuit board (PCB).

The V2X antenna may receive a first signal of a first band included in the 3G/4G band and a second signal of a second band outside of the 3G/4G band, and may receive the first signal and the second signal through a common feeding part.

The common feeding part may be vertically spaced apart from the circuit board on the basis of a predetermined distance.

The 3G/4G antenna and the V2X antenna may be disposed at a predetermined angle between each other.

It is another aspect of the present invention to provide a vehicle including a circuit board disposed on a base, a first antenna part disposed on the circuit board, an inner cover configured to cover the first antenna part, and a second antenna part disposed on a surface of the inner cover.

The second antenna part may include an amplitude modulation (AM)/frequency modulation (FM) antenna configured to receive signals of an AM/FM band and a digital multimedia broadcasting (DMB) antenna configured to receive signals of a DMB band.

The second antenna part may be disposed on at least one of an outer surface or an inner surface of the inner cover.

The AM/FM antenna may form a first conductive pattern, and the DMB antenna may form a second conductive pattern, and the first conductive pattern and the second conductive pattern may be different from each other.

The second antenna part may receive the signal through a feeding part connected to the circuit board, and the feeding part may be connected to the circuit board by a screw coupling to a clip extending from an upper side of the circuit board.

The feeding part may be connected to the circuit board by a screw coupling to a clip extending from an upper side of the circuit board.

The first antenna part may include at least one of a 3G/4G antenna configured to receive signals of a 3G/4G band, a Vehicle to Everything (V2X) antenna configured to perform V2X communication or a satellite antenna configured to receive signals of a satellite frequency band.

The V2X antenna may receive a first signal of a first band included in the 3G/4G band and a second signal of a second band outside of the 3G/4G band, and receive the first signal and the second signal through a common feeding part.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION OF ILLUSTRATIVE EMBODIMENTS

Like numerals refer to like elements throughout the specification. Not all elements of embodiments of the present disclosure will be described, and description of what are commonly known in the art or what overlap each other in the embodiments will be omitted. The terms as used throughout the specification, such as "~ part", "~ module", "~ member", "~ block", etc., may be implemented in software and/or hardware, and a plurality of "~ parts", "~ modules", "~ members", or "~ blocks" may be implemented in a single element, or a single "~ part", "~ module", "~ member", or "~ block" may include a plurality of elements.

It will be further understood that the term "connect" or its derivatives refer both to direct and indirect connection, and the indirect connection includes a connection over a wireless communication network.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof, unless the context clearly indicates otherwise.

Further, when it is stated that one member is "on" another member, the member may be directly on the other member or a third member may be disposed therebetween.

Although the terms "first," "second," "A," "B," etc. may be used to describe various components, the terms do not limit the corresponding components, but are used only for the purpose of distinguishing one component from another component.

As used herein, the singular forms "a," "an" and "the" are intended to include the plural forms as well, unless the context clearly indicates otherwise.

Hereinafter, the operating principles and embodiments of the disclosure will be described with reference to the accompanying drawings.

Figure 1:
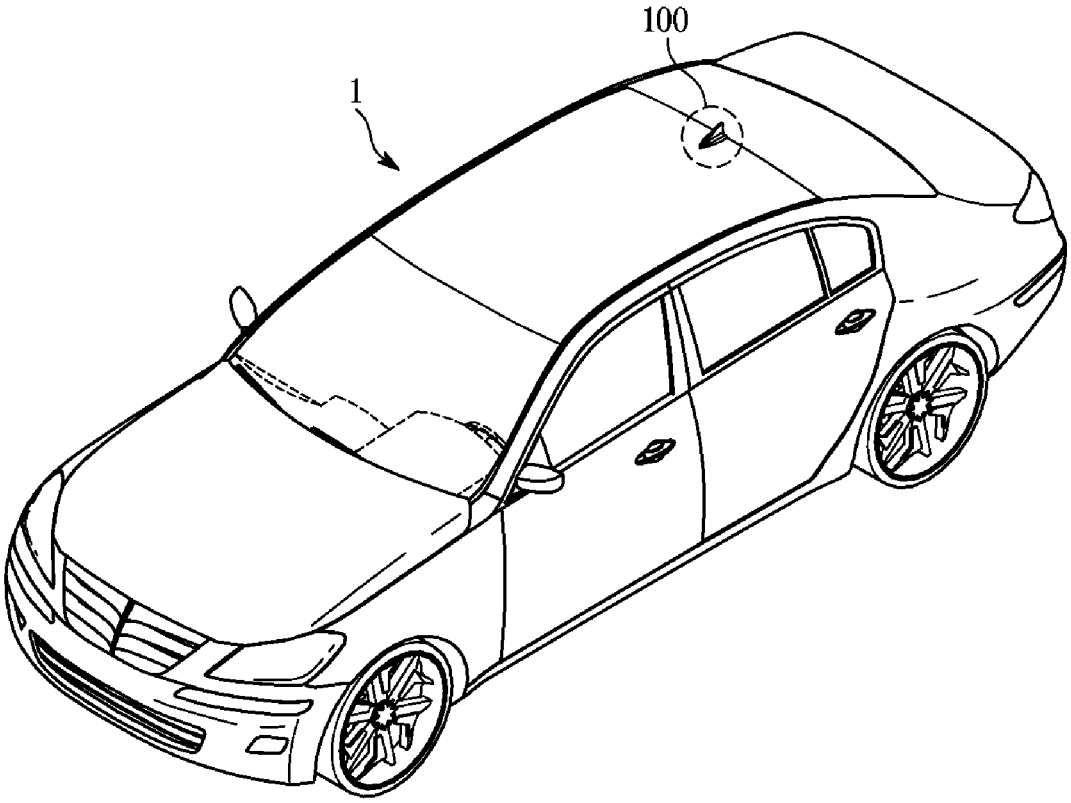
FIG. 1 is a view illustrating a vehicle according to an embodiment.

FIG. 1 is a view illustrating a vehicle according to an embodiment.

Referring to FIG. 1, a vehicle 1 according to an embodiment includes a body that forms the external appearance of the vehicle 1 and accommodates a driver and/or baggage, a chassis that includes components of the vehicle 1 except for the body, and electrical components that protect the driver or provide the driver with comfort. The body may form an interior space for the driver to stay therein, an engine room for accommodating an engine, and a trunk room for accommodating a cargo. The chassis may include devices for generating power used to run the vehicle 1 under the control of the driver and travelling/braking/steering the vehicle 1 using the power. Electrical components may control the vehicle 1, and provide the driver and passenger with safety and comfort.

A roof panel of the vehicle 1 is provided with an antenna apparatus 100 for receiving wireless signals, such as radio signals, broadcasting signals, satellite signals, and the like, and transmitting and receiving signals to and from other vehicles, servers, and base stations.

Figure 2:
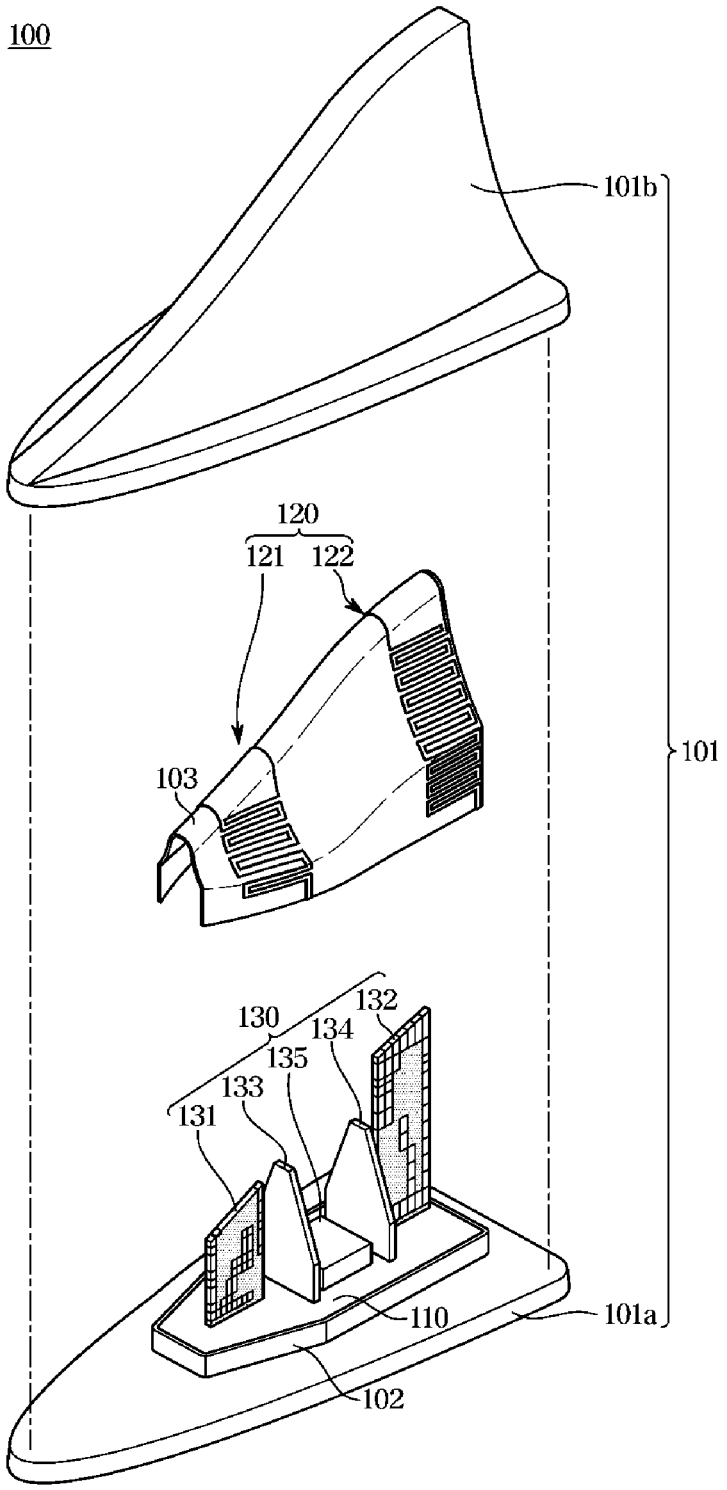
FIG. 2 is a view illustrating a structure of an antenna apparatus according to an embodiment.

FIG. 2 is a view illustrating a structure of the antenna apparatus 100 according to the embodiment.

Referring to FIG. 2, the antenna apparatus 100 according to the embodiment includes a housing 101 that includes a bottom member 101*a* mounted on the roof panel of the vehicle 1 and a cover member 101*b* coupled to the bottom member 101*a* and covering components therein.

The bottom member 101*a* is formed of synthetic resin and is attached to the body, prevents foreign substance from being introduced between the bottom member 101*a* and the cover member 101*b*, and relieves an impact transmitted from the body.

The bottom member 101*a*, which is less likely to be interfered with surrounding components, is installed at an upper rear portion of the vehicle so that a high reception ratio of wireless signals is ensured.

In addition, the bottom member 101*a* has a cross section that increases toward the rear side, thereby reducing wind resistance and noise generated in the movement of the body. However, the form of the bottom member 101*a* is not limited thereto, and the bottom member 101*a* may be provided in a form attachable to the body.

The housing 101 may be provided in a shank pin type.

The antenna apparatus 100 includes a base 102 disposed on the bottom member 101*a* and a receiving module 110 disposed on the base 102.

The base 102 may be coupled to the bottom member 101*a* by a bonding or bolting method, and may be coupled to the receiving module 110 by a bolting method.

The base 102 provides a space for mounting the receiving module 110 and antennas 121, 122, 131, 132, 133, 134, 135.

The receiving module 110 may be a circuit board on which a wire is formed by performing copper etching or the like on a substrate. For example, the receiving module 110 may be provided as a printed circuit board (PCB). The following description is made under the assumption that the receiving module 110 is a circuit board.

The receiving module 110 may include a hole allowing a wire to pass therethrough.

The receiving module 110 may include a signal processing circuit for perform signal processing by amplifying or filtering the signal received by the antennas 121, 122, 131, 132, 133, 134, 135.

The receiving module 110 transmits a signal to an electronic control unit (ECU) or a terminal mounted inside the body.

The receiving module 110 extracts and optimizes a broadcast signal of a predetermined frequency band, for example, an FM signal, an AM signal, a digital audio broadcasting (DAB) or a digital multimedia broadcasting (DMB) signal.

The receiving module 110 may be implemented as a single unified receiving module in which components, including a band pass filter (BPF), a switch, a tuner, a buffer, and a digital signal processor (DSP), are mounted on a circuit board.

The receiving module 110 may be connected to antenna parts 120 and 130 including at least one antenna 121, 122, 131, 132, 133, 134 and 135.

The antenna parts 120 and 130 may include an antenna for receiving a signal of a certain frequency band as a signal of a fundamental frequency band. The certain frequency band may represent various frequency bands of broadcast signals, such as an FM band, an AM band, a DAB band, or a DMB band.

The antenna parts 120 and 130 are mounted on the receiving module 110 and transmit the received signals to the receiving module 110.

As the antennas 121, 122, 131, 132, 133, 134, and 135, a chip antenna may be used, but various other antennas, such as a coil antenna and a microstrip patch antenna, may also be used.

In addition, the antenna apparatus 100 may further include an inner cover 103 on which the antennas 121 and 122 are disposed and which covers the circuit board. In this case, the cover member 101*b* may cover not only the components disposed on the circuit board but also the inner cover 103. To this end, the inner cover 103 may have a size smaller than that of the cover member 101*b*.

The inner cover 103 may provide a mounting space in which the plurality of antennas 131, 132, 133, 134, and 135 are installed. To this end, the inner cover 103 may be provided to be coupled to one side of the base 102 or the receiving module 110.

The antenna part 120 (the second antenna part) may be disposed on the inner cover 103, particularly, on the surface of the inner cover 103.

As shown in FIG. 2, the second antenna part 120 may be disposed on the outer surface of the inner cover 103.

However, the present disclosure is not limited thereto, and the second antenna part 120 may be disposed on the inner surface of the inner cover 103, and one of the antennas 121 and 122 constituting the second antenna part 120 may be disposed on the inner surface of the inner cover 103 and the other may be disposed on the outer surface of the inner cover 103.

Figure 3:
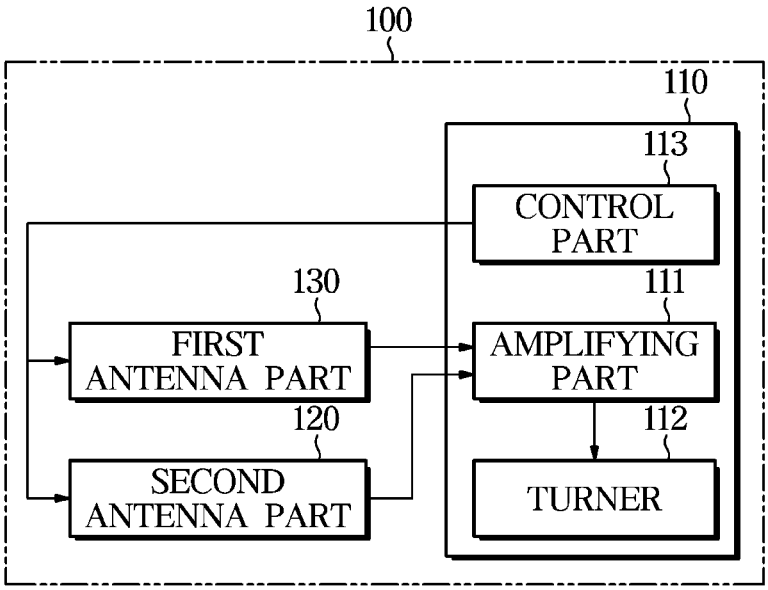
FIG. 3 is a control block diagram illustrating an antenna apparatus according to an embodiment.

FIG. 3 is a control block diagram illustrating the antenna apparatus according to the embodiment.

The antenna apparatus 100 includes the receiving module 110 including the circuit board, the first antenna part 130, and the second antenna part 120.

The receiving module 110 may include an amplifying part 111, a tuner 112 and a control part 113. Although not shown, the receiving module 110 may further include a filter for extracting only a signal of a certain frequency band among signals received from the first antenna part 130 and the second antenna part 120.

The amplifying part 111 may be a component for amplifying a signal received from the antenna parts 120, 130, and may include an amplifier for amplifying a signal of a predetermined frequency band.

The tuner 112 tunes to a frequency selected by a user to extract a signal having the selected frequency.

The control part 113 may control overall operations of the internal components of the antenna apparatus 100. The control part 113 may control the receiving frequency band of the first antenna part 130 or the second antenna part 120, or may control the impedance fluctuation range of the amplifying part 111.

The control part 113 may generate various control signals for controlling the components in the antenna apparatus 100.

The control part 113 may be implemented as a module separated from the receiving module 110 or as a module integrated with the electronic control unit (ECU) of the vehicle 1.

The control part 113 may include a memory (not shown) for storing data regarding an algorithm for controlling the operations of the components of the antenna apparatus 100 or a program that represents the algorithm, and a processor (not shown) that performs the above described operations using the data stored in the memory. At this time, the memory and the processor may be implemented as separate chips. Alternatively, the memory and the processor may be implemented as a single chip.

The control part 113 may transmit signals to the ECU or a terminal. In this case, a controller area network (CAN) communication method may be used to transmit signals.

Meanwhile, it would be understood by those skilled in the art that at least one component may be added or omitted to correspond to the performances of the components of the antenna apparatus 100 shown in FIG. 3. In addition, the mutual positions of the components may be changed to correspond to the performance or structure of the system.

Figure 4:
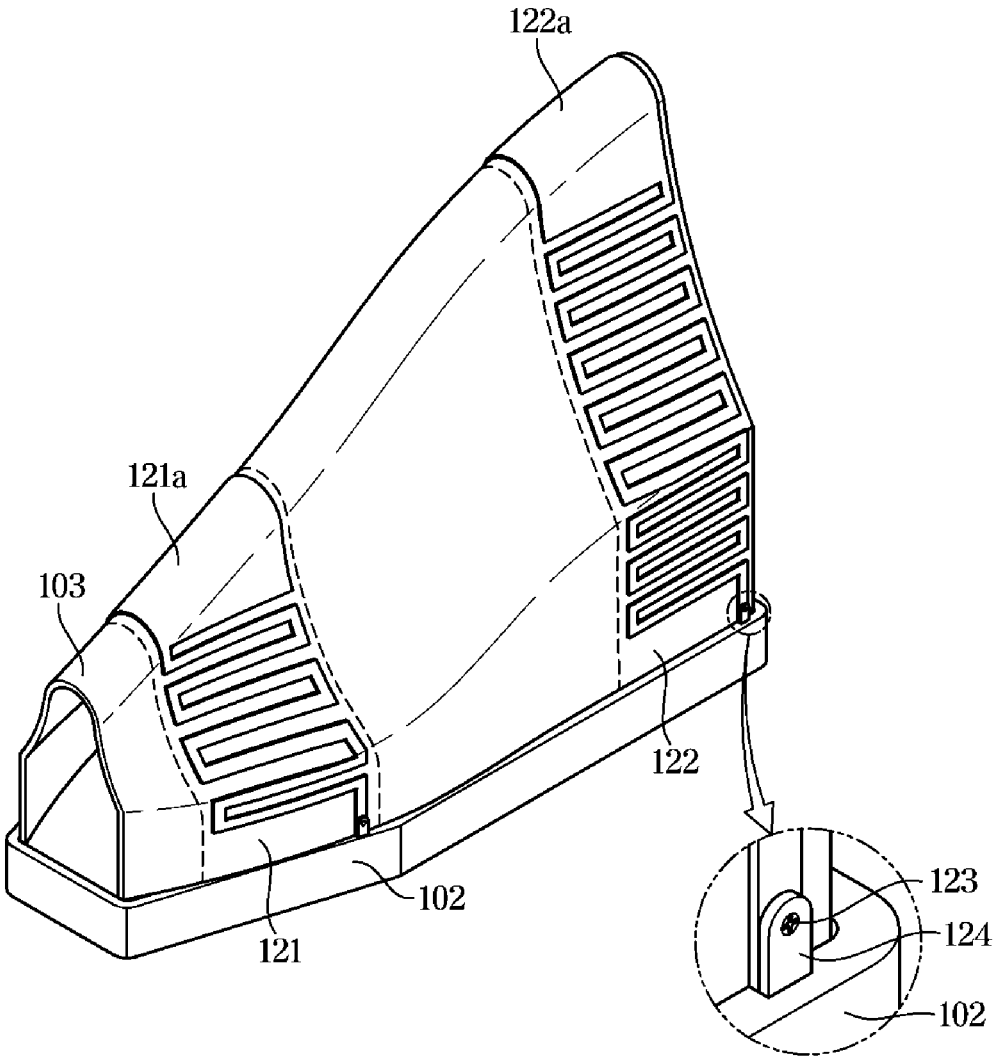
FIG. 4 is a view illustrating an inner cover of an antenna apparatus according to an embodiment.

FIG. 4 is a view illustrating the inner cover 103 of the antenna apparatus 100 according to an embodiment.

Referring to FIG. 4, the antenna apparatus 100 according to the embodiment may include the inner cover 103 for covering the internal components, and may include the second antenna part 120 disposed on the inner cover 103.

The second antenna part 120 may be disposed on the surface of the inner cover 103, and may be disposed on at least one of the outer surface or the inner surface of the inner cover 103 as described above.

The second antenna part 120 may include an AM/FM antenna 121 for receiving signal in an AM/FM band (a first band) and a DMB antenna 122 for receiving signals in a DMB band (a second band), and the AM/FM antenna 121 and the DMB antenna 122 may be disposed on the surface of the inner cover 103 to be spaced apart from each other by a predetermined distance.

The AM/FM antenna 121 is an antenna having the lowest frequency band among the antennas constituting the antenna apparatus 100, and receives signals in the AM/FM band to provide a speech-based terrestrial service in cooperation with a radio system. For example, the AM/FM antenna 121 may receive signals in a band of about 88 MHz to 108 MHz.

The DMB antenna 122 may receive signals in the DMB band. The DMB antenna 122 may receive not only the DMB band signals but also DAB band signals. In addition, the DMB antenna 122 may receive terrestrial digital multimedia broadcasting (TDMB) and HSDPA signals, digital audio broadcasting band III (DAB-III) and DAB-L signals, or GSM signals (GSM850/1900) according to the service regions of users. For example, the DMB antenna 122 may receive signals in a band of 174 MHz to 216 MHz.

The surface of the inner cover 103 may have a curved shape, and thus the second antenna part 120 may be implemented using a flexible printed circuit board (FPCB). However, the second antenna part 120 is not limited thereto, and may be implemented using a printed circuit board (PCB) or a metal plate having a predetermined shape in addition to an FPCB.

The second antenna part 120 may form conductive patterns 121*a* and 122*a*. When the second antenna part 120 is implemented using an FPCB, the conductive patterns 121*a* and 122*a* may be formed by the FPCB. In addition, the conductive patterns 121*a* and 122*a* may be formed on the inner cover 103 by a laser direct structuring (LDS) method or a direct printing antenna (DPA) method.

In this case, the AM/FM antenna 121 may form the first conductive pattern 121*a*, and the DMB antenna 122 may form the second conductive pattern 122*a* different from the first conductive pattern 121*a*.

The first conductive pattern 121*a* and the second conductive pattern 122*a* form different patterns that are electrically connected to form a coupling surface. Accordingly, wide band characteristics are provided, and a resonance change due to change in the surrounding environment is reduced, so that the reliability of the antenna performance may be enhanced.

In addition, the first conductive pattern 121*a* and the second conductive pattern 122*a* may be formed in all various directions along the surface of the inner cover 103, so that the antenna performance pattern may be formed in various shapes as long as it can be formed on the surface of the inner cover 103.

As various designs of the conductive pattern are provided and the conductive patterns are formed on the surface of the inner cover 103, even when an antenna specification is added depending on the type of the vehicle 1 or the characteristics of the region, spatial constraints are obviated. Accordingly, the convenience of the user in design may be increased.

Meanwhile, the second antenna part 120 may be attached to the surface of the inner cover 103, and may be attached to the inner cover 103 directly by bonding, soldering, taping, clipping, fusion, or the like.

However, the present disclosure is not limited thereto, and the second antenna part 120 may be more stably coupled to the surface of the inner cover 103 through a feeding part 125 for receiving signals.

Referring to FIG. 4, the second antenna part 120 may include a feeding part 123 connected to the receiving module 110, and may be connected to the circuit board of the receiving module 110 through at least one of a metallic contact portion fixed to the feeding part 123, a plurality of protrusions, a C-clip, and metal screw fastening.

In this case, the connection to the circuit board may include not only a physical connection but also an electrical connection.

In detail, the feeding part 123 may have a connection structure in which the feeding part 123 is connected to a clip 124 extending from an upper portion of the receiving module 110 by a metal screw fastening method. For example, the feeding part 123 may be connected to the clip 124 by a screw fastening, and the signal of the second antenna part 120 may be transmitted to the circuit board of the receiving module 110 through the feeding part 123.

Such a fastening structure with the circuit board of the receiving module 110 through the feeding part 123 may secure not only physical connection but also electrical connection between the feeding part 123 and the receiving module 110. At the same time, degradation of performance of the feeding part 123 due to vibration of the vehicle 1 may be prevented, and reliability of performance of the antenna apparatus 100 may be ensured.

Figure 5:
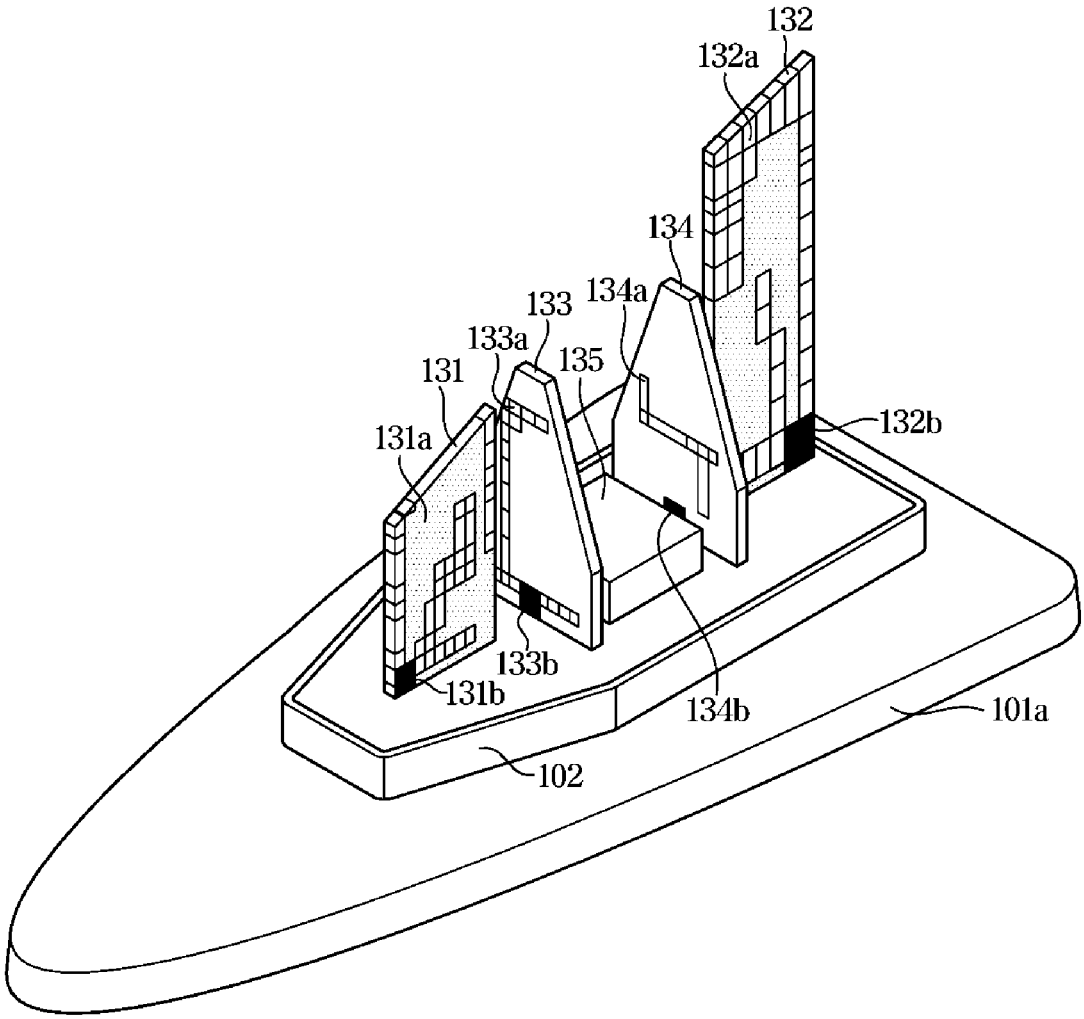
FIG. 5 is a view for describing a first antenna part of an antenna apparatus according to an embodiment.

FIG. 5 is a view for describing the first antenna part of the antenna apparatus according to the embodiment.

Referring to FIG. 5, the antenna apparatus 100 according to the embodiment may include the first antenna part 130, and the first antenna part 130 may be installed on one side of the receiving module 110 disposed on the base 102.

For example, the first antenna part 130 may be installed perpendicular to the upper side of the receiving module 110, and may include at least one antenna 131, 132, 133, 134, and 135.

In this case, the at least one antenna 131, 132, 133, 134, and 135 may be mounted in a space provided by the inner cover 103.

The first antenna part 130 may be implemented using a PCB.

The first antenna part 130 includes 3G/4G antennas 131 and 132 for receiving signals in the 3G/4G band, V2X antennas 133 and 134 for performing Vehicle to Everything (V2X) communication, and a satellite antenna 135 for receiving satellite signals.

The 3G/4G antennas 131 and 132 may receive signals in the 3G/4G band. For example, the 3G/4G antennas 131 and 132 may receive signals in a band from 1750 MHz to 1870 MHz.

The 3G/4G antennas 131 and 132 may include a first 3G/4G antenna 131 and a second 3G/4G antenna 132, and the first 3G/4G antenna 131 and the second 3G/4G antenna 132 may be positioned at opposite ends of the one side of the receiving module 110 to be spaced apart from each other. In this case, the first 3G/4G antenna 131 and the second 3G/4G antenna 132 may be positioned on the same axis on the one side of the receiving module 110. However, the positions of the first 3G/4G antenna 131 and the second 3G/4G antenna 132 are not limited thereto, and may include another case as long as the first 3G/4G antenna 131 and the second 3G/4G antenna 132 are positioned on the one side of the circuit board of the receiving module 110 to be spaced apart from each other.

In this case, the 3G/4G antennas 131 and 132 may form conductive patterns 131*a* and 132*a*. The first 3G/4G antenna 131 and the second 3G/4G antenna 132 may form different conductive patterns 131*a* and 132*a*. Since the conductive patterns 131*a* and 132*a* are different from each other, the first 3G/4G antenna 131 and the second 3G/4G antenna 132 do not affect each other, so that the degree of isolation may be improved.

Each of the 3G/4G antennas 131 and 132 may be disposed on the circuit board of the receiving module 110 to be spaced apart from the V2X antennas 133 and 134 and the satellite antenna 135 by predetermined intervals.

In addition, the first 3G/4G antenna 131 and the second 3G/4G antenna 132 may receive power through feeding parts 131*b* and 132*b*, respectively. The feeding parts 131*b* and 132*b* may be positioned on sides of the first 3G/4G antenna 131 and the second 3G/4G antenna 132, particularly, end portions of the first 3G/4G antenna 131 and the second 3G/4G antenna 132.

That is, the feeding parts 131*b* and 132*b* may be spaced apart from each other, and radiator interference may be minimized.

Meanwhile, the 3G/4G antennas 131 and 132 may be designed in a monopole type to minimize the interference with the second antenna part 120.

The V2X antennas 133 and 134 may receive signals for performing V2X communication.

The V2X antennas 133 and 134 may be implemented using a PCB, for example, a Teflon substrate, or a FR4 (Flame Retardant 4, Fr-4) substrate.

The V2X antennas 133 and 134 may receive signals not only in the V2X frequency band but also in the Wi-Fi frequency band, as a wide band antenna that allows Wi-Fi to be usable within the vehicle 1 in combination with the V2X frequency band and the Wi-Fi frequency band.

The V2X antennas 133 and 134, as a wide band antenna, may receive a first signal of a first band included in the 3G/4G band and a second signal of a second band. In this case, the first band and the second band may be signal bands different from each other.

For example, the first band is included in the 3G/4G band and the second band is included outside of the 3G/4G band.

For another example, the first band may be a relatively low frequency band of 1710 MHz to 2690 MHz, and the second band may be a relatively high frequency band of about 5.9 GHz.

The V2X antennas 133 and 134 may include a first V2X antenna 133 and a second V2X antenna 134. The first V2X antenna 133 and the second V2X antenna 134 may form conductive patterns 133*a* and 134*a* different from each other. Since the conductive patterns 133*a* and 134*a* are different from each other, the first V2X antenna 133 and the second V2X antenna 134 do not affect each other, so that the degree of isolation may be improved.

In addition, the first conductive pattern 133*a* formed by the first V2X antenna 133 is divided into a first sub pattern for receiving the signal of the first band and a second sub pattern for receiving the signal of the second band.

In other words, the first V2X antenna 133 are provided with divided conductive patterns for respective band signals in a single PCB such that signal receptions of the first band and the second band that are different from each other may be independently performed from each other.

In addition, the first V2X antenna 133 may receive signals of the first band and the second band through a common feeding part 133*b*. That is, the first V2X antenna 133 may share the common feeding part 133*b* for the signals of the first and second bands.

In this case, the antenna apparatus 100 may further include a diplexer to compensate for the degree of isolation of signals in the first band and the second band due to sharing the common feeding part 133*b*, and the diplexer may be included in the base 102 or the receiving module 110.

The common feeding part 133*b* may be positioned on the PCB of the first V2X antenna 133, and vertically spaced apart from the receiving module 110 or the base 102 on the basis of a predetermined distance.

That is, the common feeding part 133*b* may be provided at a position higher than that of the circuit board of the receiving module 110 or the base 102. In this case, the common feeding part 133*b* may further include a cable connected from the receiving module 110.

Meanwhile, when the receiving module 110 or the base 102 includes a ground plane, the common feeding part 133*b* may be disposed at a position higher than that of the ground plane.

Since the ground plane and the common feeding part 133*b* are structurally separated from each other, the V2X antennas 133 and 134 may have a higher gain in the horizontal direction with respect to the ground plane when the antenna apparatus 100 is mounted on the roof panel of the vehicle 1. In addition, when the dipole multiplication antenna is implemented, the radiation pattern may be adjusted to have an angle of 90 degrees or more, which may be effective for increasing the performance.

That is, the accuracy and reliability of V2X communication may be increased.

The second V2X antenna 133 may also be provided with the conductive pattern 134*a* that is divided into a first sub pattern and a second sub pattern to thereby receive signals of different bands through a common feeding part 134*b*. The description thereof is the same as that of the first V2X antenna 132.

In this case, the V2X antennas 133 and 134 may be implemented using an LTE 4×4 MIMO (Multi-Input Multi-Output) antenna system.

Meanwhile, the V2X antennas 133 and 134 may be disposed on the circuit board of the receiving module 110 to be spaced apart from the 3G/4G antennas 131 and 132 or the satellite antenna 135 by predetermined distances.

In addition, the V2X antennas 133 and 134 may be disposed between the first 3G/4G antenna 131 and the second 3G/4G antenna 132, and may be disposed apart from the satellite antenna 135 in opposite directions. Such a spacing structure, the degree of isolation may be improved.

In order to improve the degree of isolation, the V2X antennas 133 and 134 may be disposed at predetermined angles with respect to the 3G/4G antennas 131 and 132. In this case, the predetermined angles may be determined as an optimal angle for improving the degree of isolation between the antennas 131, 132, 133, 134, and 135.

Referring to FIG. 5, the V2X antennas 133 and 134 and the 3G/4G antennas 131 and 132 may be arranged perpendicular to each other while standing upright on the circuit board of the receiving module 110.

The satellite antenna 135 represents an antenna capable of receiving a satellite frequency. On the basis of the satellite frequencies, the vehicle 1 may provide the position, speed, running information of the vehicle 1, and the like.

The satellite antenna 135 may include antennas capable of receiving satellite frequencies of GPS (USA), Glonass (Russia), and Galileo (Europe). The satellite frequency bands may be higher frequency bands when compared to the AM/FM band.

The satellite antenna 135 may be implemented in a ceramic form and may include a dielectric.

The satellite antenna 135 may be disposed on the circuit board of the receiving module 110 to be spaced apart from the V2X antennas 133 and 134 or the 3G/4G antennas 131 and 132 by predetermined distances.

Figure 6:
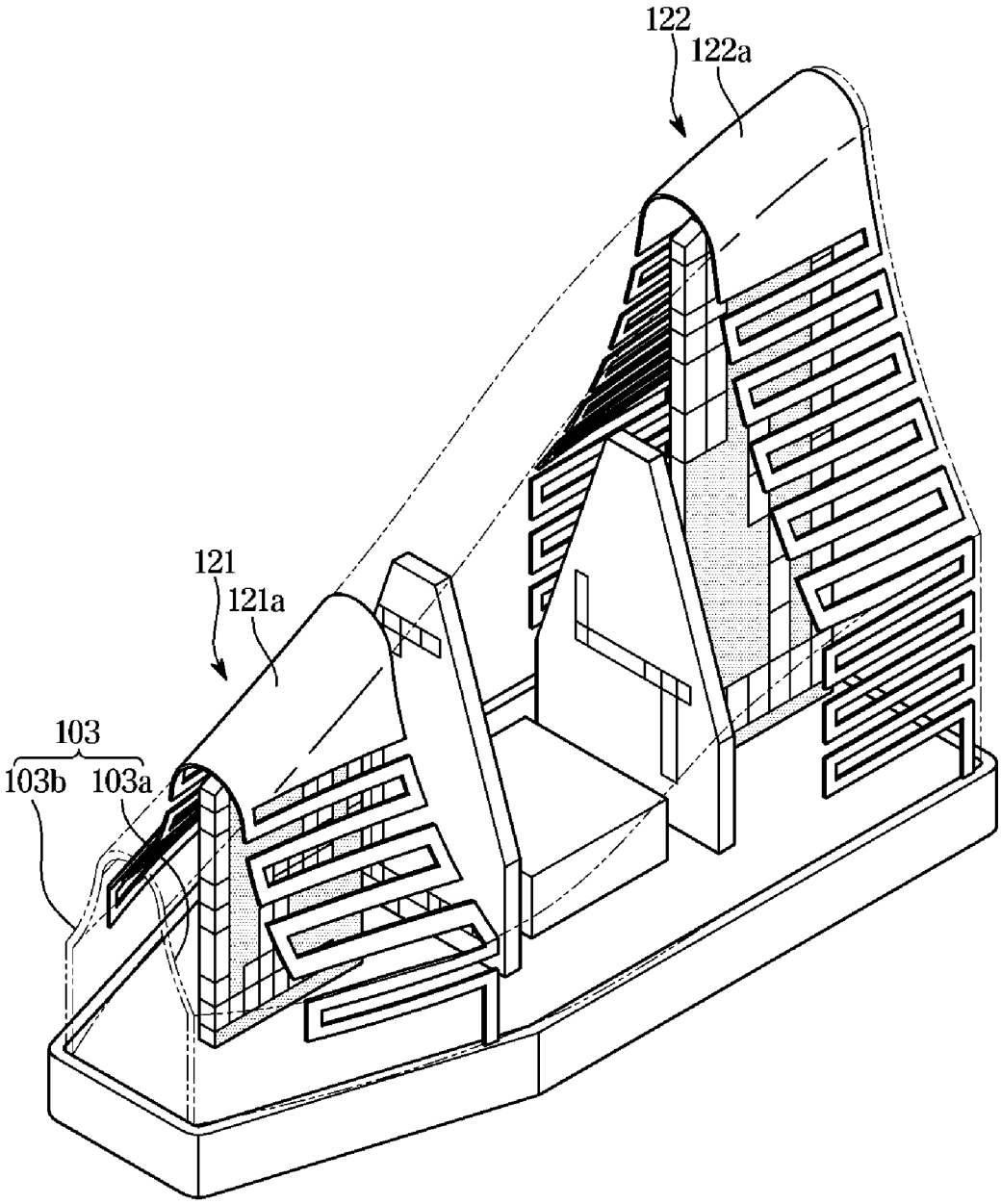
FIG. 6 is a view for describing an example of conductive patterns formed in an antenna apparatus according to an embodiment.

FIG. 6 is a view for describing an example of conductive patterns formed in the antenna apparatus according to the embodiment.

Referring to FIG. 6, the second antenna part 120 of the antenna apparatus 100 according to the embodiment may form the conductive patterns 121*a* and 122*a* on the surfaces 103*a* and 103*b* of the inner cover 103.

Each of the conductive patterns 121*a* and 122*a* is formed all over a first surface 103*a* that is a front side on the basis of an upper outline of the inner cover 103 and a second surface 103*b* connected to the first surface 103*a*.

In this case, the conductive patterns 121*a* and 122*a* formed on the first surface 103*a* may be symmetrical to the conductive patterns 121*a* and 122*a* formed on the second surface 103*b*.

However, the conductive patterns 121*a* and 122*b* are not limited to the above-described embodiment, and may be formed in all various directions along the surface of the inner cover 103, so that the antenna performance pattern may be formed in various shapes as long as it can be formed on the surface of the inner cover 103.

In addition, a high speed communication of 1 Gbps or so may be achieved through the antennas 131, 132, 133, 134 and 135 of the first antenna part 130 and the antennas 121 and 122 of the second antenna part 120.

As is apparent from the above, the antenna according to one aspect and the vehicle including the same can construct a high-speed data communication environment by transmitting signals through a plurality of different antennas in a limited space.

Although embodiments have been described with reference to the accompanying drawings, those skilled in the art will appreciate that these inventive concepts may be embodied in different forms without departing from the scope and spirit of the disclosure, and should not be construed as limited to the embodiments set forth herein. The disclosed embodiments have been described for illustrative purposes and not for limiting purposes.

What is claimed is:

1. An antenna apparatus comprising:

a planar printed circuit board disposed on a base;

a first antenna part disposed on the planar printed circuit board and implemented using the planar printed circuit board;

an inner cover configured to cover the first antenna part; and a second antenna part disposed on a surface of the inner cover and implemented using a flexible printed circuit board.

2. The antenna apparatus of claim 1, wherein the second antenna part includes:

an amplitude modulation (AM)/frequency modulation (FM) antenna configured to receive signals of an AM/FM band; and a digital multimedia broadcasting (DMB) antenna configured to receive signals of a DMB band.

3. The antenna apparatus of claim 2, wherein the AM/FM antenna forms a first conductive pattern, and the DMB antenna forms a second conductive pattern, the first conductive pattern and the second conductive pattern being different from each other.

4. The antenna apparatus of claim 1, wherein the second antenna part is disposed on an outer surface of the inner cover.

5. The antenna apparatus of claim 1, wherein the second antenna part is configured to receive a signal through a feeding part connected to the planar printed circuit board.

6. The antenna apparatus of claim 5, wherein the feeding part is connected to the planar printed circuit board by a screw coupling to a clip extending from an upper side of the planar printed circuit board.

7. The antenna apparatus of claim 1, wherein the first antenna part comprises a 3G/4G antenna configured to receive signals of a 3G/4G band.

8. The antenna apparatus of claim 1, wherein the first antenna part comprises a Vehicle to Everything (V2X) antenna configured to perform V2X communication and wherein the V2X antenna is configured to receive a first signal of a first band included in a 3G/4G band and a second signal of a second band outside of the first band and to receive the first signal and the second signal through a common feeding part.

9. The antenna apparatus of claim 8, wherein the common feeding part is vertically spaced apart from the planar printed circuit board based on a predetermined distance.

10. The antenna apparatus of claim 1, wherein the first antenna part comprises a 3G/4G antenna configured to receive signals of a 3G/4G band and a Vehicle to Everything (V2X) antenna configured to perform V2X communication, wherein the 3G/4G antenna and the V2X antenna are disposed at a predetermined angle between each other.

11. The antenna apparatus of claim 1, wherein the second antenna part is disposed on an inner surface of the inner cover.

12. The antenna apparatus of claim 1, wherein the first antenna part comprises a Vehicle to Everything (V2X) antenna configured to perform V2X communication.

13. The antenna apparatus of claim 1, wherein the first antenna part comprises a satellite antenna configured to receive signals of a satellite frequency band.

14. A vehicle comprising:

a base;

a rigid planar printed circuit board mounted on a top surface of the base and extending away from top surface of the base;

a first antenna part that includes antenna portions printed on the rigid planar printed circuit board;

an inner cover configured to cover the rigid planar printed circuit board with the first antenna part and the top surface of the base;

a flexible printed circuit board disposed on the inner cover; and a second antenna part that includes antenna portions printed on the flexible printed circuit board.

15. The vehicle of claim 14, wherein the second antenna part includes:

an amplitude modulation (AM)/frequency modulation (FM) antenna configured to receive signals of an AM/FM band; and a digital multimedia broadcasting (DMB) antenna configured to receive signals of a DMB band.

16. The vehicle of claim 15, wherein the AM/FM antenna forms a first conductive pattern and the DMB antenna forms a second conductive pattern, the first conductive pattern and the second conductive pattern being different from each other.

17. The vehicle of claim 14, wherein the second antenna part is further disposed on an outer surface of the inner cover.

18. The vehicle of claim 14, wherein the second antenna part is configured to receive a signal through a feeding part connected to the rigid planar printed circuit board.

19. The vehicle of claim 14, wherein the first antenna part comprises:

a 3G/4G antenna configured to receive signals of a 3G/4G band;

a Vehicle to Everything (V2X) antenna configured to perform V2X communication; or a satellite antenna configured to receive signals of a satellite frequency band.

20. The vehicle of claim 14, wherein the first antenna part comprises a Vehicle to Everything (V2X) antenna configured to perform V2X communication and wherein the V2X antenna is configured to receive a first signal of a first band included in a 3G/4G band and a second signal of a second band outside of the first band and to receive the first signal and the second signal through a common feeding part.

* * * * *